United States Patent [19]

Garner et al.

[11] 4,407,033

[45] Oct. 4, 1983

[54] COMBINATION TOE AND SIDE LASTING MACHINE

[75] Inventors: Derek H. Garner; Frank C. Price, both of Leicester; Philip Reader, Thornton; David W. Whittingham, Blaby; Anthony M. White, Oadby; Joseph A. Shutt, Rearsby; Nicholas J. Campling, Loughborough, all of England

[73] Assignee: USM Corporation, Farmington, Conn.

[21] Appl. No.: 332,253

[22] Filed: Dec. 18, 1981

[30] Foreign Application Priority Data

Dec. 20, 1980 [GB] United Kingdom ..... 8040923

[51] Int. Cl.[3] ..... A43D 21/00; A43D 3/00

[52] U.S. Cl. ..... 12/10.1; 12/123

[58] Field of Search ..... 12/10.1, 10.5, 10.8, 12/123, 125, 33.6, 12, 12.4, 12.5, 14.4, 14.3; 118/415

[56] References Cited

U.S. PATENT DOCUMENTS 3,675,260 7/1972 Kamborian et al. ..... 12/10.1

4,000,535 1/1977 Barton ..... 12/126

FOREIGN PATENT DOCUMENTS 1760704 12/1977 Fed. Rep. of Germany ..... 12/10.5

*Primary Examiner*—Patrick D. Lawson

*Attorney, Agent, or Firm*—Donald N. Halgren

[57] ABSTRACT

A single-station combined toe and side lasting machine comprises pulling over instrumentalities 20, 22 for tensioning an upper over its last, toe lasting instrumentalities, including toe wipers 38, toe pad 48 and toe band 50, a heel support 56, two adhesive applying nozzles 28 and side lasting instrumentalities 114 constituted by two lasting rollers 176. In operation, with the upper tensioned, first the shoe is clamped by the toe lasting instrumentalities and heel support to allow adhesive to be applied progressively along opposite side portions from the toe to heel breast. Then the lasting rollers operate progressively from the ball region to the heel breast, and, when the rollers have cleared the ball region, the inwiping movement of the toe wipers is completed. The nozzles and side lasting rollers are mounted on a common carriage 26 which moved rectilinearly, supports 116 for the rollers being mounted for movement thereon about three perpendicular axes 82, 122, 140. The rollers are also supported by carriers 174 on said supports for pivotal movement about a further axis 170. In this way, the rollers can follow the contour of the shoe bottom and also the angular relationship of the rolers with the shoe bottom can be varied in two planes. For following the shoe bottom contour the rollers (and also, independently, the nozzled) are moved by stepping motors 80, 166 (96) in accordance with a program instruction, under the control of which also the angular relationship is varied. The carriers for the rollers also support wiping fingers 222 which ensure that the lasting margin of the upper is correctly positioned for engagement by the rollers.

29 Claims, 8 Drawing Figures

IV
28
176
206
204
208
174
210
172
170
168
212
202
94
182
186
214
114
92
200
180
188
116
196
184
190
194
192
216
198
218
108
106
104
86
110
112
118
124
120
134
136
132
122
130
158
126
128
154
88
84
90
82
160
138
140
146
68
96
70
152
150
144
148

COMBINATION TOE AND SIDE LASTING MACHINE

BACKGROUND OF THE INVENTION (1) Field of the Invention

This invention is concerned with shoe upper conforming machines, more especially machines for performing a combined toe and side lasting operation on shoe uppers. The term "shoe" is used herein generically as indicating outer footwear generally, and as including an article of outer footwear in the course of its manufacture.

(2) Prior Art

One machine for performing a combined tow and side lasting operation on shoe uppers is commercially available, said machine comprising a last support, for supporting, bottom facing down, a last on which a shoe upper and insole are assembled, a plurality of grippers arranged about the last support for gripping marginal portions of an upper and tensioning it about its last, toe end lasting means, comprising wiper plates by which lasting marginal portions of the toe region of the upper can be wiped over and pressed against corresponding marginal portions of the insole, two side lasting assemblies by which lasting marginal portions of the opposite side regions of the upper can be wiped over and pressed against corresponding marginal portions of the insole, and adhesive applying means movable relative to the shoe bottom whereby to cause the adhesive to be applied progressively between the lasting marginal portions of the upper and corresponding marginal portions of the insole, prior to such portions being wiped over and pressed as aforesaid.

In said machine, the last support and grippers are arranged at a central so-called pulling over station to which alternately each of two toe end lasting means is movable, the arrangement being such that the toe end means at the pulling over station is caused to operate to move the wiper plates to an "interrupt" position, in which leading marginal portions thereof engage and clamp marginal portions of the upper against corresponding marginal portions of the insole, in the region of the periphery of the insole only, the grippers being caused to release the upper as it is so clamped, and also the last support moving out of engagement with the shoe bottom. The toe end lasting means, with the shoe now held against the wiper plates, is then moved out of the pulling over station (the other toe end lasting means being moved thereto) and the shoe held thereby is then presented to the side lasting assemblies (which, in the machine in question, are movable widthwise of the machine at the rear thereof), the toe end lasting means being capable of swinging about an axis extending widthwise of the machine to carry the shoe through an arc so that it is presented, bottom uppermost, to the side lasting instrumentalities. In this position, adhesive is applied by the adhesive applying means, which comprises two sets of nozzles, each set comprising two nozzles. A first set are utilized for applying adhesive from the joint region heelwardly towards the heel breast line, while the other set apply adhesive toewardly from the joint region to the toe. Thereafter, the side lasting assemblies are caused to last the opposite side regions of the upper and there after the toe end lasting means is effective to cause the inwiping movement of the wiper plates to continue, whereby the toe end of the shoe is lasted.

Using such a machine, the shoe-making quality obtained is generally regarded as good, but it will be appreciated that such a machine is necessarily of large dimensions; further, its construction is complicated, and thus expensive, not least because of the need to move the two toe end lasting mens bodily not only widthwise of the machine but about the axis extending widthwise of the machine.

It is the object of the present invention to provide an improved machine for performing a combined toe and side lasting operation on shoe uppers, which machine is more compact than the previous machine and cheaper to produce, while retaining the shoe-making qualities achieved using the earlier machine.

BRIEF SUMMARY OF THE INVENTION

The invention thus provides a machine for performing a combined tow and side lasting operation on shoe uppers, comprising, a last support, for supporting, bottom facing down, a last on which a shoe upper and insole are assembled, a plurality of grippers arranged about the last support for gripping marginal portions of an upper and tensioning it about its last, and tow end lasting means, comprising wiper plates by which lasting marginal portions of the toe region of the upper can be wiped over and pressed against corresponding marginal portions of the insole, wherein the last support and grippers are mounted on a support arrangement which is bodily movable between an operative position, in which a last with an upper tensioned thereoon as aforesaid, is supported with the shoe bottom in a wiping plane (as determined by the wiper plates), and an out-of-the-way position, and further wherein, with the support arrangement in its operative position, the toe end lasting means is caused to operate to move the wiper plates to an "interrupt" position in which leading marginal portions thereof engage and clamp marginal portions of the upper against corresponding marginal portions of the insole, i the region of the periphery of the insole only, the grippers being caused to release the upper as it is so clamped, and the machine also comprising two side lasting assemblies by which lasting marginal portions of the opposite side regions of the upper can be wiped over and pressed against corresponding marginal portions of the insole, and adhesive applying mens, comprising two nozzles, movable relative to the shoe bottom whereby to cause adhesive to be applied progressively between the lasting marginal portions of the upper and corresponding marginal portions of the insole, in which machine the nozzles are mounted on a further support arrangement which is movable, beneath the level of the toe end lasting means, along a rectilinear path to cause the nozzles supported thereby to apply adhesive progressively along toe and side portions of the shoe bottom, after the inwiping movement of the wiper plates has been interrupted, and prior to such movement being continued, and also prior to operation of the side lasting assemblies, the support arrangement for the last support and grippers being mounted for movement heightwise of the machine between its operative and out-of-the-way positions, and said further support arrangement for the nozzles being movable as aforesaid when the first-mentioned support arrangement has been moved to its out-of-the-way position.

It will thus be appreciated that the machine in accordance with the invention is readily produced in a single-station form. Furthermore, the part of the machine which now moves to an out-of-the-way position, viz. the last support and grippers, are inoperative at the time of so moving, so that there is no danger of a shoe is maintained stationary, clamped against the wiper plates of the toe end lasting means. In addition, presentation of the shoe to the side lasting assemblies, and also the general construction of the adhesive applying means is considerably simplified.

In the commercially available machine referred to above, furthermore, the control of the nozzles, are they are caused to apply adhesive as aforesaid, is by means of templates. Bearing in mind that there are two sets of nozzles, two sets of templates are therefore required. Furthermore, at least in the case of the templates for controlling the movement of the nozzles along side portions of the shoe bottom, either a grading mechanism has to be provided to accommodate a size range of a given style, which grading mechanism is likely to be mechanically complicated and therefore expensive, or a set of templates of different sizes has to be provided.

The particular arrangement of the various integers of the machine in accordance with the invention, on the other hand, lends its self readily to a numerically controlled arrangement for effecting movement of the nozzles along the shoe bottom, apart from the fact that it is proposed to use only one set of nozzles for applying adhesive to the whole of the area to be lasted. To this end, therefore, conveniently the nozzles are mounted on said further support arrangement each for movement independently of the other widthwise of the shoe bottom, the movement of said further support arrangement along its rectilinear path being under the control of a numerically controlled motor (as herein defined) and also a numerically controlled motor (as herein defined) being associated with each nozzle for effecting widthwise movement thereof, said motors operating in response to a sequence of control signals supplied in accordance with a programmed instruction according to the style and size of shoe being operated upon. By "numerically controlled motor" where used herein is to be understood a motor the operation of which is controlled by control pulses supplied thereto in accordance with digitized information appropriate to the desired operation of the motor. Where two motors operate in conjunction with one another, e.g. to move a tool along a desired path, the digitized information is usually in the form of digitized co-ordinate axis values. Examples of such motors are stepping motors and d.c. servomotors. Thus, a set of digitized co-ordinate axis values, e.g. derived from a model shoe bottom, can be used to control the numerically controlled motor for the further support arrangement and each such motor for the nozzles, whereby the nozzles are caused to track along opposite side portions of the shoe bottom from the toe end thereof along a desired path. Furthermore, by providing a suitable grading program, only a single set of co-ordinate axis values need be stored for each style, and further the program may be utilized for lefts and rights, e.g. merely by reversing the Y axis movement.

As in the commercially available machine referred to above, each side lasting assembly comprises a lasting roller rotatable about an axis extending widthwise of the shoe bottom and being provided with a wiping element disposed helically about the circumference thereof. In the machine in accordance with the invention, furthermore, each side lasting assembly is supported by the further support arrangement whereby the lasting rollers are brought into engagement with and caused to operate along opposite side portions of the shoe bottom. Furthermore, for the sake of structural simplicity, each lasting roller is preferably supported by an arm which is mounted on said further support arrangement for movement abut axes extending heightwise, widthwise and lengthwise of the rectilinear path of said arrangement. In this way, each roller is mounted for movement, independently of the other, both towards and away from the shoe bottom and also widthwise thereof, and further the angular relationship of the roller to the shoe bottom in a place extending widthwise of the shoe bottom, can be varied during the lasting cycle. Furthermore, each roller is preferably carried on a support mounted on its associated arm, which support is mounted for movement about an axis extending heightwise of said arm, whereby the angular relationship of the roller to the shoe bottom can also be varied, during the lasting operation, according to the contour of the shoe bottom, in a place parallel, or substantially parallel, to the shoe bottom.

In order to ensure that each lasting roller follows a path corresponding to the she bottom, preferably the movement of each arm about an axis extending heightwise of the path of said further support arrangement is under the control of a numerically controlled motor (as herein defined), said motors also operating in response to a sequence of control signals supplied in accordance with the programmed instruction according to the style and size of shoe being operated upon. Furthermore, separate fluid pressure operated means are preferably provided for effecting the movement of the arm about an axis extending lengthwise of said path and for effecting movement of each roller support about an axis extending heightwise of the arm, each such fluid pressure operated means operating in response to control signals supplied thereto in accordance with the programmed instruction according to the style and size of shoe being operated upon. In this way, as the model shoe bottom is digitized for the purpose of steering the nozzles and lasting rollers along opposite sides there of as aforesaid, the programmer may also include control information relating to the desired angular relationship between each roller and the shoe bottom in planes extending both widthwise of, and parallel, or substantially parallel, to, the shoe bottom.

In the commercially available machine referred to above, furthermore, in order to ensure that each lasting roller, as it is moved into engagement with the shoe bottom, properly engages a lasting marginal portion and an press it against a corresponding marginal portion of the insole, two wiping fingers are provided which engage the lasting margin of the upper, wipe it over and press it against a corresponding marginal portion of the insole in the region at which the lasting roller associated therewith is to be brought into such engagement. In the machine in accordance with the invention, a wiping finger arrangement is also provided, such arrangement in this case being preferably mounted on the roller support, and means, e.g. fluid pressure operated means, being provided for moving each arrangement on the support between an operative condition, in which it projects beyond the roller, in a direction towards the shoe bottom to be operated upon, and an out-of-the-way condition, the arrangement being such that each arrangement is moved to its operative condition to engage the lasting marginal portion of the upper in advance of its associated roller. It will thus be appreciated that, because the wiping finger arrangement is now mounted on the roller support, the relationship between the roller and its associated finger arrangement is fixed (as opposed to the arrangement in the commercially available machine, in which the position of the roller was independent of the position of the wiping finger). In the machine in accordance with the invention, furthermore, each wiping finger arrangement preferably comprises two fingers arranged closely adjacent and one at each side of the roller associated therewith.

In the commercially available machine referred to above, a shoe length sensing device is provided, associated with a heel support which is movable into engagement with a heel end of a shoe to be operated upon after the upper has been gripped as aforesaid, which shoe length sensing device controls certain size-related functions of the machine. Because of the mechanical nature of the machine, however, the mechanisms required for relating the length of shoe sensed and setting up various cams is necessarily complicated. In the machine in accordance with the invention, therefore, preferably shoe length sensing means is provided, but its use is more closely related to the digitized information which controls the machine operation, with a result that the control system for the machine is greatly simplified.

One particular area in which this arrangement is especially useful resides in that, when the machine is in use, the programmed instruction can be selected merely according to the style of shoe to be operated upon (said instruction being derived from a single model size), and the shoe length sensing means may then be effective, through a grading program, to cause the path of the various instrumentalities supported by the further support arrangement to be modified according to the size of such shoe. Thus, this system enables not only the path of movement of the nozzles and lasting rollers to be determined according to the size of the shoe, but also the change in angular relationship between the shoe bottom and the rollers, as above described, can be similarly varied according to the length of the shoe.

Conveniently the shoe length sensing means comprises a signalling device, constituted by a linear potentiometer, which is connected to the heel support and which supplies a reference signal having a value which varies proportionately with the movement of the heel support.

The commercially available machine referred to above also comprises means whereby the inwiping movement of the wiper plates of the toe end lasting means is interrupted, said interrupting means comprising a stop engageable by an abutment movable with the wiper plates. Furthermore, for varying the "interrupt" position of the wiper plates, the stop is movable along a path, into a position determined according to the length of the shoe to be operated upon as sensed by the shoe length sensing means, thus to vary the amount of movement of the abutment in engaging said stop. If, however, the "interrupt" position of the wiper plates is incorrectly determined, damage to the shoe, and perhaps also to the macine, could ensue, especially where the movement of the wiper plates is interrupted before the shoe is engaged. In the machine in accordance with the invention, therefore preferably a sensing device is provided for sensing the position to which the stop has moved as aforesaid, means also being provided for sensing the position to which the stop has moved as aforesaid, means also being provided for comparing the outputs of the sensing device and of the shoe length sensing means and for preventing the continued operation of the machine in the event of said outputs being imcompatible. Preferably, the sensing means comprises an inductance switch between which and a member having a plurality of apertures relative movement takes places when the stop is moved along its path as aforesaid, the arrangement being such that the switch "counts" apertures, the number "counted" varying according to the distance moved by the stop along said path.

It will be appreciated that, when the wiper plates reach their "interrupt" position, the support arrangement for the last support and grippers has to be signalled to move to its out-of-the-way position, and also a further signal is required to initiate movement of said further support arrangement, whereby to cause the nozzles and lasting rollers to begin their operation on the shoe bottom. In order to ensure the correct sequencing, it has been customary to use mechanically operated sequence switches or valves. However, in the machine in accordance with the invention, which utilizes numerical control, conveniently there is associated with the toe end lasting means a signalling device, e.g. a linear potentiometer, which supply the signal having a value which varies proportionately with the movement of the wiper plates, the arrangement being such that, as the toe end lasting means is caused to operate, the signal is "read" at frequent intervals and, upon the value of the signal being "read" as unchanged over a succession of readings (thereby indicating that the movement of the wiper plates has been interrupted), said support arrangement for the last support and grippers is caused to move to its out-of-the-way position.

The heel support of the commercially available machine referred to above comprising auxiliary clamp means arranged to engaged with opposite sides of the last after the upper has been gripped and tensioned as aforesaid. In the machine in accordance with the invention, the auxiliary clamp means may also be provided, and in such a case, when, at the end of a lasting cycle, the heel support is retracted to release the shoe, the auxiliary clamping means remains in clamping engagement with the shoe over at least part of the retracting movement of the heel support. In this way, it is ensured that the shoe is withdrawn from the wiper plates, subsequent release of the auxiliary clamp means then being effective to cause the shoe more reliably to drop into a receptacle provided for finished shoes.

BRIEF DESCRIPTION OF THE DRAWINGS

There now follows a detailed description, to be read with reference to the accompanying drawings, of one machine in accordance with the invention, which machine has been selected for description merely by way of exemplification of the invention and not by way of limitation.

In the accompanying drawings.

DESCRIPTION OF THE PREFERRED EMBODIMENTS

Figure 1:
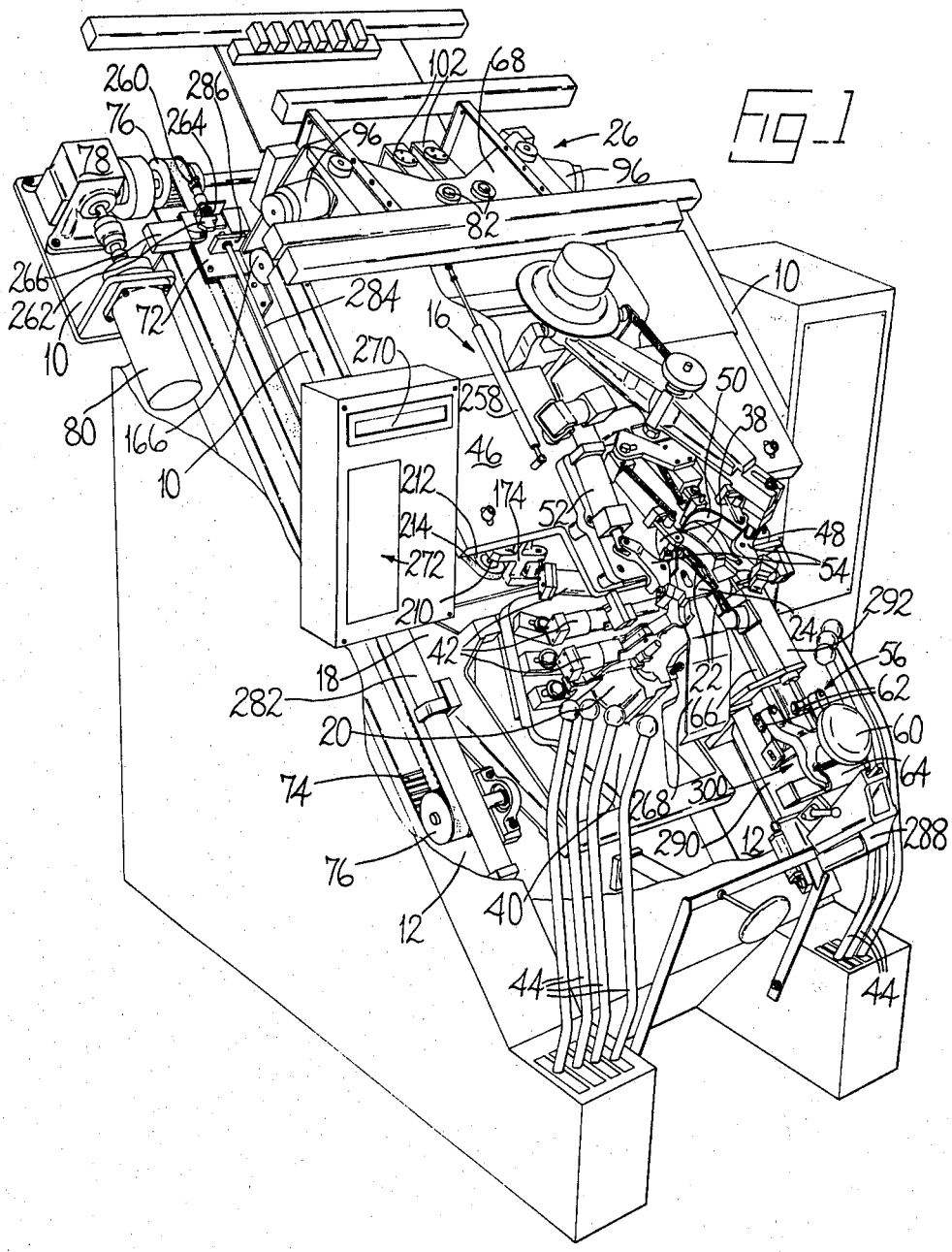
FIG. 1 is a perspective view from the front left hand side of the machine, showing a first support arrangement for a last post and grippers in an operative position and a second support arrangement for the nozzles and lasting rollers in an out-of-the-way position.

A machine in accordance with the invention is a machine for performing a combined toe and side lasting operation on shoe uppers, said machine comprising a main frame 10 having inclined box-formed support members 12 supporting each a slide rod 14. The angle of inclination of said members 12 is approximately 45° to the vertical, this angle determining the angle of presentation of a shoe S to be lasted to the various instrumentalities of the machine. The machine in accordance with the invention also comprises a wiper head generally designated 16 bolted to the main frame 10, a first support arrangement generally designated 18 for supporting a last support 20 and a plurality of (in case seven) grippers 22 arranged in a horse-shoe around the last support, which latter comprises an insole support plate 24, and a second support arrangement generally designated 26 for supporting the adhesive applying means, in the form of two nozzles 28, and side lasting instrumentalities, in the form of two lasting rollers 176.

The first support arrangement 18 is mounted for pivotal movement about a shaft 32 extending transversely of the machine, towards the rear thereof, on lugs 34 arranged beneath the support members 12, fluid pressure operated means in the form of a piston-and-cylinder arrangement 36 mounted in the machine frame 10 being provided for effecting pivotal movement of said first support arrangement. The first support arrangement is thus pivotal between an operative position, in which a shoe supported thereby can be located with the bottom thereof in a wiping plane, as determined by the plane of toe wiper plates 38 carried in the wiper head 16, and an out-of-the-way position (see FIG. 7*b*) in which the 1st support 20 and grippers 22 are moved away from said plane. The grippers 22 re mounted on a common base plate 40, secured to the first support arrangement 18, and are operated by fluid pressure operated means, including piston-and-cylinder arrangements 42, in a conventional manner whereby the grippers are caused to close on the lasting marginal portions of an upper of a shoe placed on the last support and to be drawn downwardly whereby to tension the upper over its last. Also as conventional, a plurality of levers 44, one associated with each gripper 22, are provided for enabling the machine operator a discretionary pull facility after the initial tensioning of the upper on its last. (The general arrangement of the grippers may be described in our co-pending U.K. patent application No. 8014728, or alternatively a co-called two-stage last support arrangement may be provided, whereby the insole plate 24 is first disposed below the wiping plane and is moved into the wiping plane after the upper has been gripped and tensioned by the grippers 22 as aforesaid.)

The wiper head 16 of the machine is generally of the conventional "fixed head" type, the inwiping movement of the wiper plates 38 being controlled by a cam plate (not shown) secured to a carrier plate 46 which is bolted to the main machine frame 10. Furthermore, mounted on the carrier plate 46 for lateral swinging movement between a position, in which it is in opposed relationship with the insole plate 24, and an out-of-the-way position, and also, when in said first position, for heightwise movement towards and away from the insole plate 24, is a toe pad 48. The construction and arrangement of the toe pad 48 and its support is generally as described in U.K. patent specification No. 1351192.

Also mounted on the carrier plate 46 is a toe band arrangement, including a toe band 50 which can be closed on to a shoe the upper of which has been gripped and tensioned as aforesaid by fluid pressure operated means 52 acting through a linkage 54. Again, the tow band arrangement is of conventional construction.

The machine in accordance with the invention also comprises a heel support arrangement generally designated 56 comprising a V-shaped block 58 supported for movement towards the insole plate 24, thus to engage with the heel end of a shoe supported on the plate 24. Apart from being adjustable heightwise, the block is also movable heightwise under power, through a diaphragm piston 60, when bedding pressure is applied to the toe end of the shoe, as will be hereinafter referred to. The heel support arrangement also comprises two clamp member 62, mounted for pivotal movement and arranged to engage the cone of the 1st of the shoe being operated upon, one at either side thereof, thus to hold the shoe more firmly at the heel end. For operating the clamp members 62, a common piston-and-cylinder arrangement 64 is provided.

The machine in accordance with the invention also comprises, associated with the heel support arrangement 56, shoe length sensing means constituted by a linear potentiometer 66, which supplies a reference signal having a value which varies proportionately with the movement of the heel support as aforesaid. The purpose of the reference signal will be referred to hereinafter.

Figure 2:
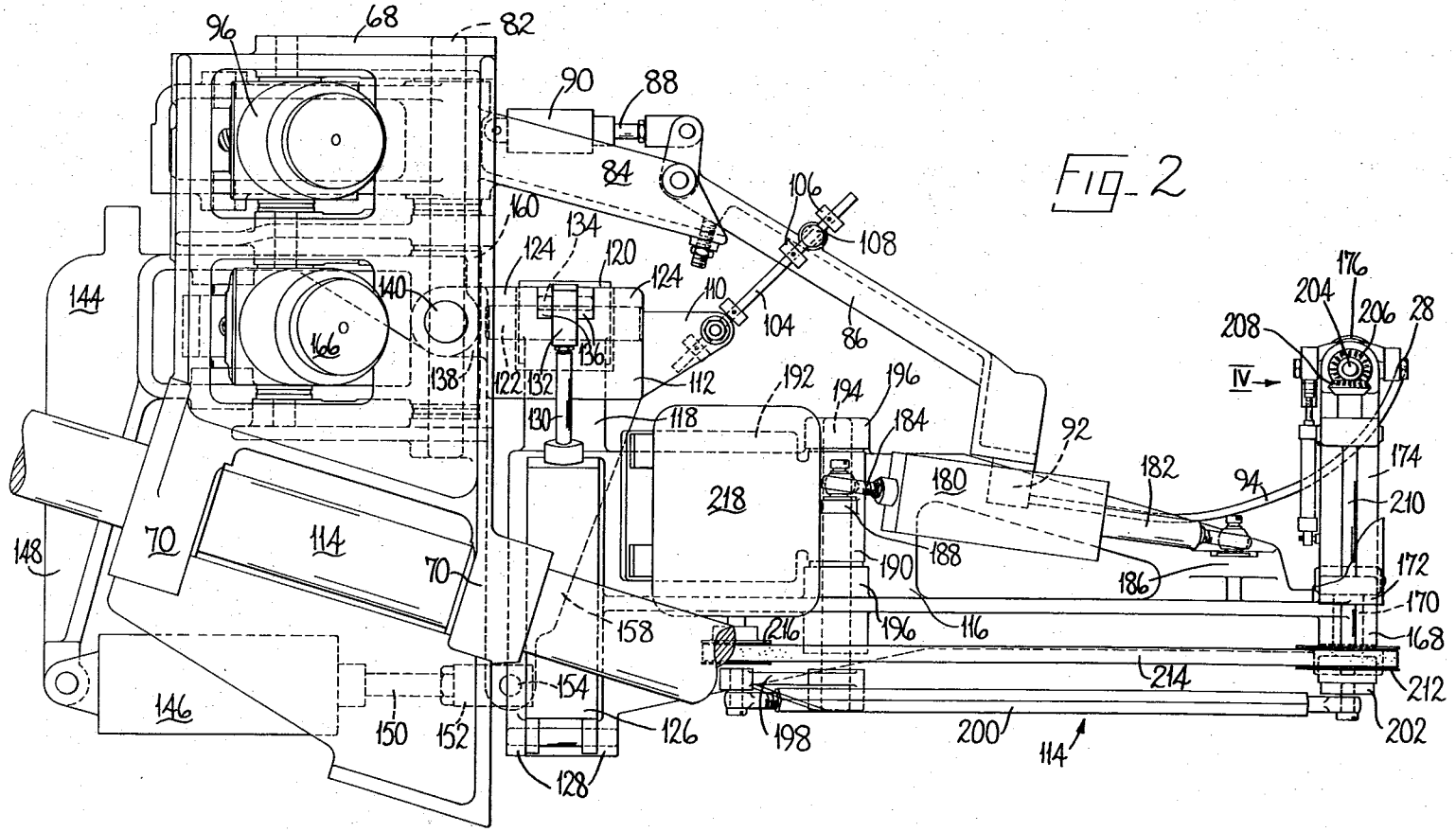
FIG. 2 is a view in side elevation showing details of the second support arrangement for the nozzles and lasting rollers.
Figure 3:
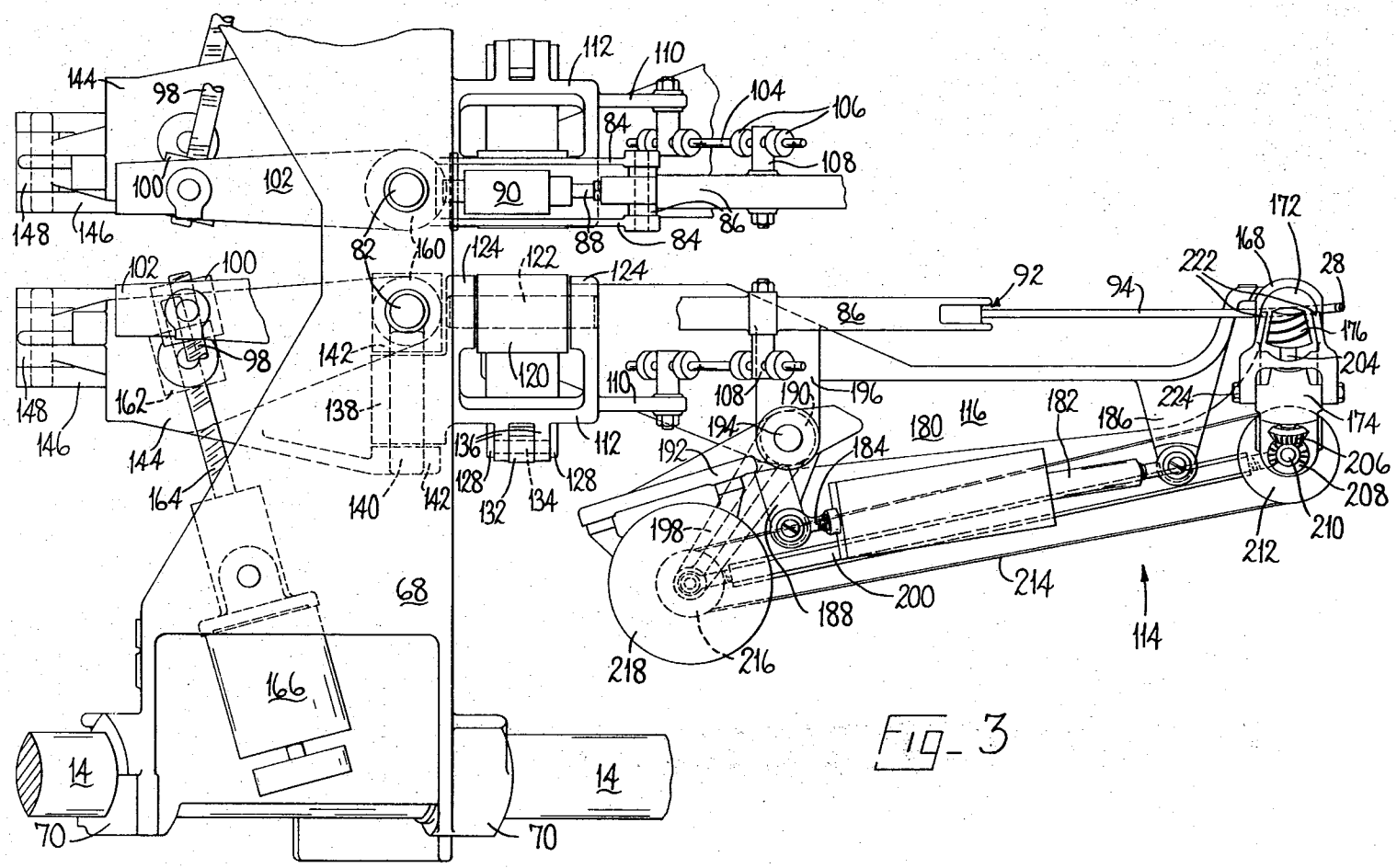
FIG. 3 is a plan view of parts shown in FIG. 2.

The second support arrangement 26 (FIGS. 2 and 3) is mounted for sliding movement in a rectilinear path on the slide rods 14. The second support arrangement comprises a transverse bridge member 68 lugs 70 of which support the member on the slide rods. Furthermore, secured to each end of the bridge member 68 is a plate 72 to which opposite ends of a timing belt 74 are secured, said belts each running round two pulleys 76 mounted, spaced apart, in bearings on the support members 12. The upper pulleys are driven through a gear box 78 by means of a stepping motor 80 (constituting a numerically controlled motor). Thus, operation of the stepping motor 80 is effective to move the second support arrangement 26, which is disposed beneath the level of the wiper head 16, forwardly along the slide rods 14.

The bridge member 68 of the second support arrangement 26 is a casting and provides a support for various operating instrumentalities of the machine. Thus, mounted adjacent a front edge of the bridge member are two vertical pivot pins 82, on an upper end of each of which, captive in the bridge member, is a forwardly extending support arm 84. Each arm 84 supports a bell crank lever 86 to one, short, art of which is pivotally connected a piston rod 88 of a piston-and-cylinder arrangement 90 mounted on the arm 84. The other, longer, arm of the lever 86 provides a support for a melt chamber 92 to which hot melt adhesive can be supplied in rod form and from which the melted adhesive can pass along a supply pipe 94, the end of said supply pipe in each case constituting a nozzle 28. Thus, each nozzle 28 can, by pivotal movement about its associated pin 82, be arranged to move widthwise of the machine, and also, by operation of its associated cylinder 90, can be moved heightwise into and out of engagement with a shoe bottom.

For moving each nozzle 28 widthwise of the machine, two stepping motors 96 are carried in the bridge member 68, one associated with each nozzle. Each stepping motor 96 comprises a threaded output drive shaft 98 which is connected threadedly in a block 100 pivotally supported on a rearward extension 102 of the support member 84. Thus, operation of the stepping motor 96 is effective to cause the support arm 84 to pivot about the pivot pin 82. For controlling the amount of heightwise movement of each nozzle 28, furthermore, a limiting member 104 having two abutments 106 arranged one at either side of a block 108 on the bell crank lever 86, and also threadedly adjustable relative thereto, is pivotally mounted on a lug 110 of a casting 112 to be referred to hereinafter.

Also mounted on the bridge member, beneath the nozzle mounting arrangement hereinbefore described, are two side lasting assemblies generally designated 114 each comprising an arm 116 in the form of a casting, which arm has, formed integral therewith at its rearward end, an upstanding post section providing a collar portion 120 through which passes a pivot pin 122 which is supported between upstanding lugs 124 of the casting 112. For pivoting the arm 116 about the axis of its associated pin 122, furthermore, a piston-and-cylinder arrangement 126 is pivotally mounted in downwardly extending lugs 138 of the arm 116 and a piston rod 130 carries at its upper end a block 132 secured to a pin 134 carried in lugs 136 formed on the casting 112. The piston-and-cylinder arrangement 126 thus constitutes fluid pressure operated means for effecting pivotal movement of the arm 116 about the axis of the pin 122, which of course extends lengthwise of the bottom of the shoe to be operated upon.

The casting 112 is itself provided with a rearwardly extending collar portion 138 in which is received a transversely extending pivot pin 140 opposite ends of which are held captive in two lugs 142 formed integral with and extending forwardly of a further casting 144. For pivoting the casting 112 about the axis of the pin 140, furthermore, a piston-and-cylinder arrangement 146 is pivotally mounted on a depending support section 148 of the casting 144, a piston rod 150 of said arrangement 146 carrying a block 152 supported on a pin 154 carried in two lugs 156 on a downwardly extending support section 158 of the casting 112. The piston-and-cylinder arrangement 146 thus constitutes fluid pressure operated means for effecting movement of its arm 116 about the axis of the pin 140, i.e. an axis extending widthwise of the bottom of a shoe to be operated upon.

The casting 144 has formed integral with a forward end portion thereof a collar portion 160 by means of which said casting is supported on the pivot pin 82 carried by the bridge member 68. Furthermore, for effecting pivotal movement of the casting 144, and thus of its associated arm 116, about the axis of the pivot pin 82, a block 162 is carried by the casting and threadedly received an output shaft 164 of a stepping motor 166 which is carried by the bridge member 68. Thus, the arm 116 is caused to pivot about an axis extending heightwise of the bottom of a shoe to be operated upon under the control of the stepping motor 166.

At the forward end of each arm 116 there is formed integral therewith, a collar portion 188 supporting an upstanding pivot pin 170, opposite ends of which are accommodated in lugs 172 formed integral with a carrier 174 for a lasting roller 176, the arrangement being such that the axis of the pin 168 passes through the portion of the operating surface of the roller 176 which engages the shoe bottom. The lasting roller 176 is generally frusto-conical and is provided about its circumference with a helically disposed wiping element 178. The carrier 174, and thus the roller 176, can thus pivot about the axis of the pin 168, and, for effecting such pivotal movement a piston-and-cylinder arrangement 180 is provided which comprises two pistons (not shown) having piston rods 182, 184, each movable in its own cylinder portion, said piston rods projecting from opposite ends of the arrangement. One (182) of the piston rods is pivotally secured to a lug 186 formed on the arm 116, towards the forward end thereof, while the other piston rod 184 is pivotally secured to a lever 188 in turn connected to a collar portion 190 formed integral with a plate member 192, the collar portion accommodating a vertical pivot pin 194 opposite ends of which are held in two lug portions 196 formed integral with the arm 116. The collar portion 190 is keyed to the pivot pin 194, and the pin also has fixedly secured to a lower end portion thereof a lever 198, to the free end portion of which is pivotally secured a rod 200 which is pivotally connected, at its opposite end, to a lever 202 carried at the lower end of the carrier 174. Thus, operation of the piston-and-cylinder arrangement 180 is effective through the linkage arrangement just described to cause the plate member 192 to pivot about the axis of the pin 194 and also to cause the carrier 174 for the lasting roller 176 to pivot about the axis of pin 170.

The lasting roller 176 is mounted for rotation about the axis of a support shift 204, extending widthwise of the bottom of the shoe to be operated upon, said shaft being carried in an upper end of the support carrier 174. At its opposite end the support shaft 204 carries a bevel gear 206 meshing with a further bevel gear 208 carried at one end of an upstanding shaft 210 supported by the roll carrier 174, a lower end of said shaft carrying a pulley 212. The pulley is operatively connected by a belt drive 214 to a further pulley 216 mounted on the output drive shaft of an electric motor 218 carried by the plate member 192. The pulleys 212, 216 are mounted with their axes coincident with the connection between the rod 200 and the levers 202, 198 respectively. In this manner, once the correct tension has been provided in the belt 214 (and this is achieved by a facility for adjusting the effective length of the rod 200), the tension is maintained even during the pivoting of the roll carrier about the axis of the pin 170.

The piston-and-cylinder arrangement 180, which by its construction and arrangement is capable of providing four different operative positions (the lengths of the two piston rods 182, 184 being different), thus constitutes fluid pressure operated means for effecting pivotal movement of the lasting roller 176 about an axis extending heightwise of the bottom of the shoe to be operated on.

Figure 4:
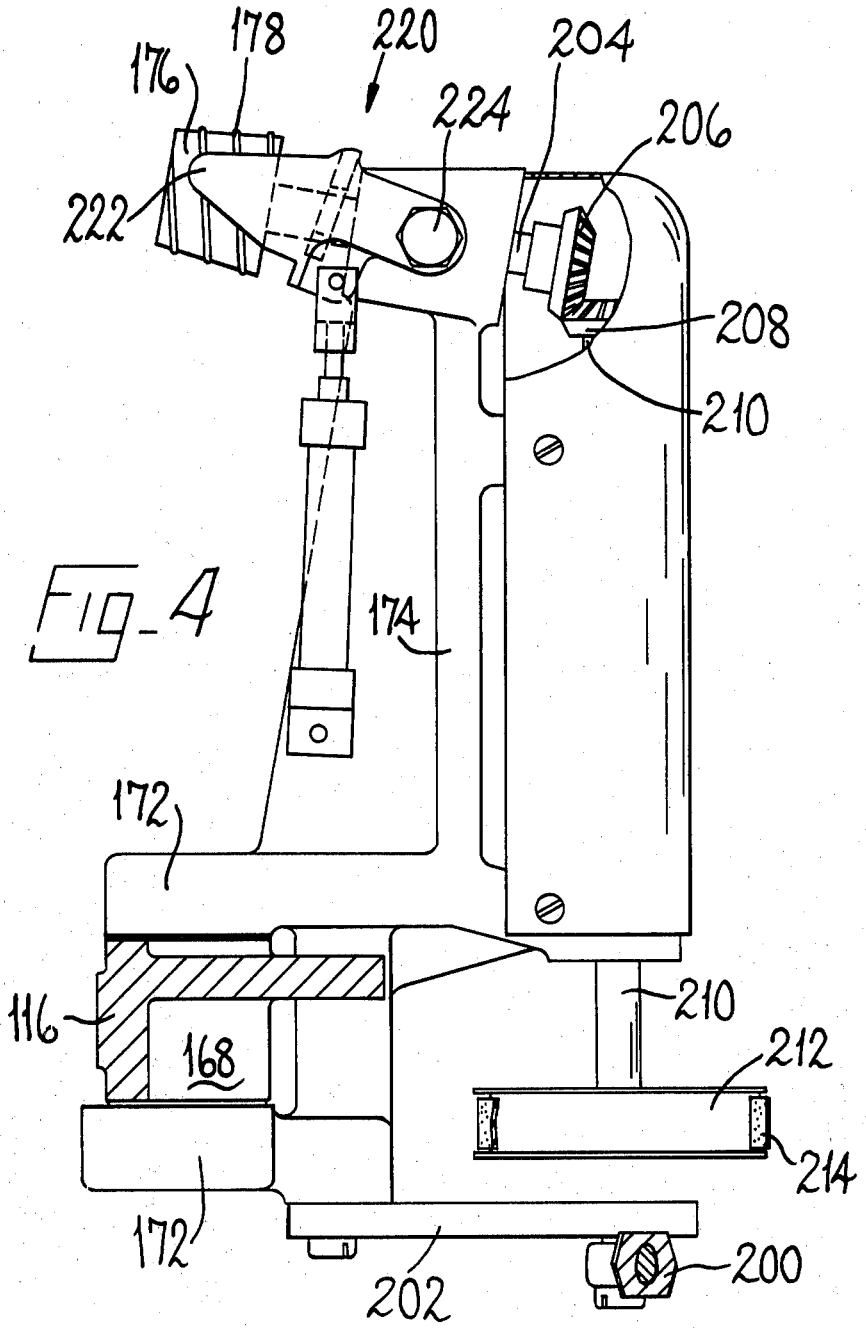
FIG. 4 is a fragmentary view of a support for a lasting roller viewing in the direction of the arrow IV shown in FIG. 2.
Figure 5:
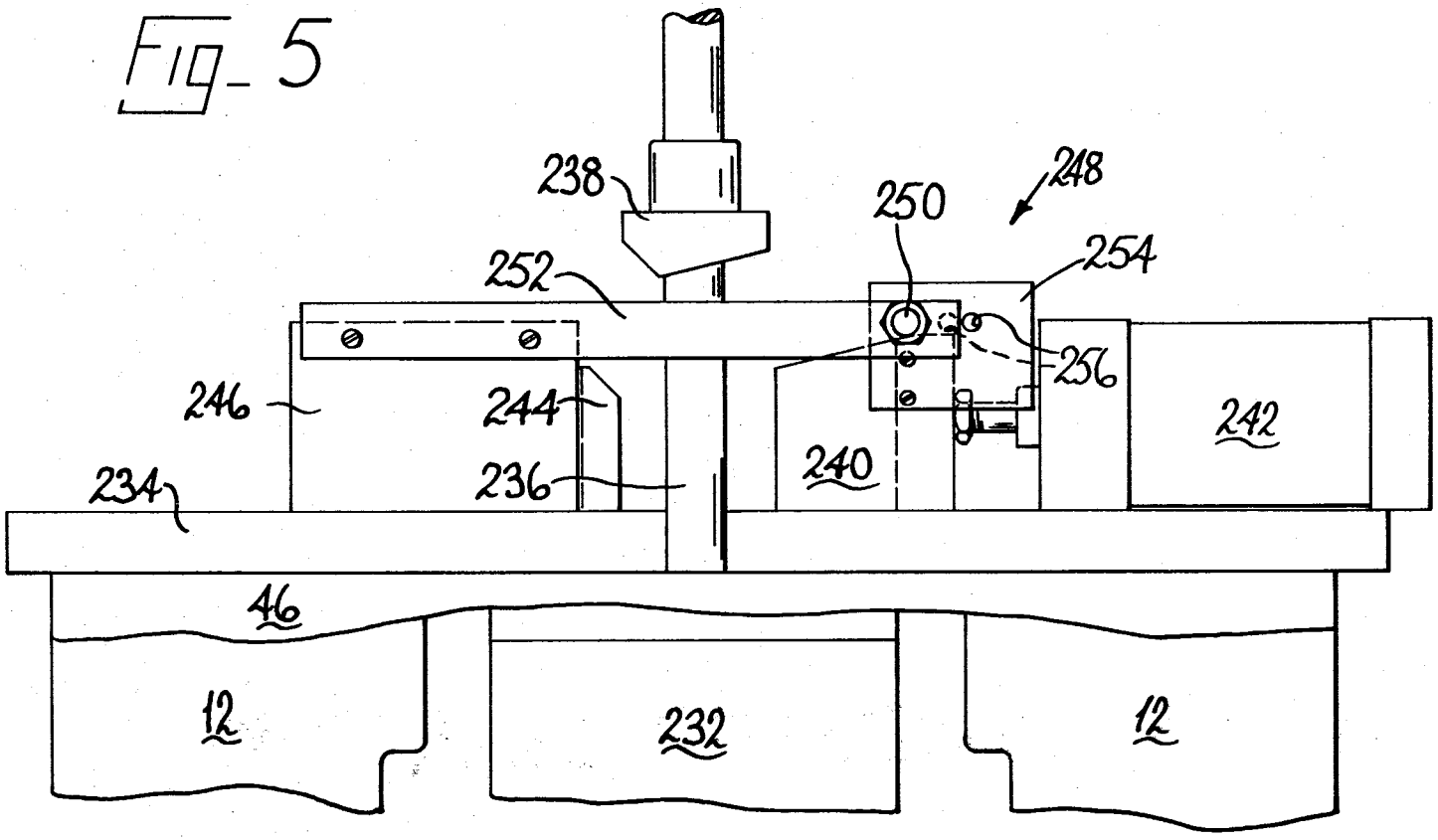
FIG. 5 is a fragmentary view showing details of means for interrupting the inwiping movement of the wiper plates of toe end lasting means of the machine.
Figure 6:
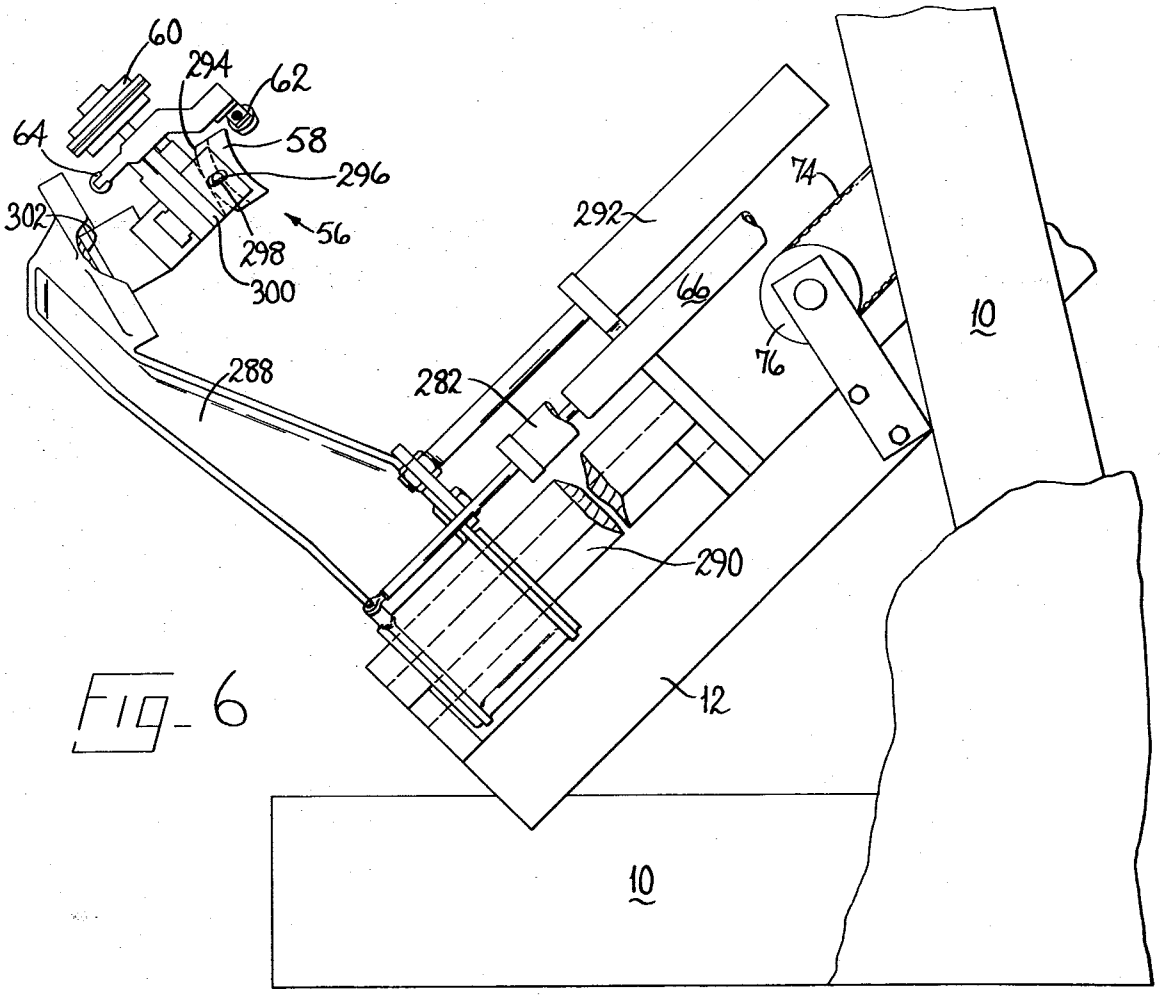
FIG. 6 is a fragmentary view showing details of a heel support arrangement.

The machine in accordance with the invention also comprises a wiping finger arrangement generally designated 220 (see FIG. 4), said arrangement comprising two wiping fingers 222 arranged one at each side of the lasting roller 176, said fingers being mounted for pivotal movement each on a support pin 224, the axes of the pins being coincident and extending lengthwise of the bottom of the shoe being operated upon. For effecting pivotal movement of the fingers, a U-shaped yoke member 226 is pivotally connected to both fingers, said member being carried on a piston rod 228 of a piston-and-cylinder arrangement 230 pivotally supported on the carrier 174. The fingers 222 are moved by said piston-and-cylinder arrangement into an operative condition, in which they project upwardly beyond the lasting roller associated therewith, in a direction towards the shoe bottom to be operated upon, and an out-of-the-way condition, the arrangement being such that the fingers are moved to their operative condition to engage the lasting marginal portion of the upper in advance of the lasting roller associated therewith.

In order to enhance the support of the shoe during the lasting operations thereon, side clamp members 274 are mounted, for pivotal movement into and out of an operative condition, on an upper surface of the carrier plate 46. For effecting movement of said members, fluid pressure operated means in the form of piston-and-cylinder arrangements 276 are provided, also mounted on said plate. In addition, also for supporting the shoe during the lasting operation, an auxiliary last support 278 may be provided, by means of which the shoe can be supported when the first support arrangement 18, and the last support 20 therewith, is moved out of its operative position. For operating the auxiliary last support, which is mounted on the main machine frame in such a manner as not to impede movement of either of the support arrangements 18, 26 or the instrumentalities mounted thereon, fluid pressure operated means, comprising a piston-and-cylinder arrangement 280, may be provided. In the operation of the machine the auxiliary last support pressure is applied as above described to the shoe bottom.

At the end of the cycle of operation of the machine, the second support arrangement 26 is returned to its initial condition, returning the nozzles 28 and the lasting rollers 176 therewith. In order to facilitate this return movement cushioning cylinders 282 may be provided, mounted on the support members 12 and each accommodating a piston therein, each connected by piston rod 284 to a bracket 286 on the plate 72. As the second support arrangement 26 moves forwardly, the pressure in the cylinders 282 builds up, this built-up pressure being utilized to return the second support arrangement 26 to its initial condition at the end of the operation.

The heel support arrangement 56 of the machine in accordance with the invention is carried on a casting constituting a support arm 288 which in turn is carried on a rectangular shaft 290 for sliding movement therealong, thus to bring the heel support arrangement 56 into and out of pressing engagement with a shoe. For thus moving the support arm 288, fluid pressure operated means in the form of a piston-and-cylinder arrangement 292 is provided, mounted on a right hand one of the support members 12. The dimensions of the bearing surfaces of the support arm, which are in contact with the rectangular shaft, and also the cross-sectional dimensions of the shaft are so selected that pressing the V-shaped block 58 against the shoe S, as above described, is effective to cause the contacting bearing surfaces to bind on one another, in the manner of a bar lock, thus to lock the heel arrangement 56 in a position of pressing engagement with the shoe. Thus, the piston-and-cylinder arrangement 292 is merely for bringing the heel support arrangement into contact with the shoe, and does not serve itself to maintain such contact during the operation of the machine.

Figure 7A:
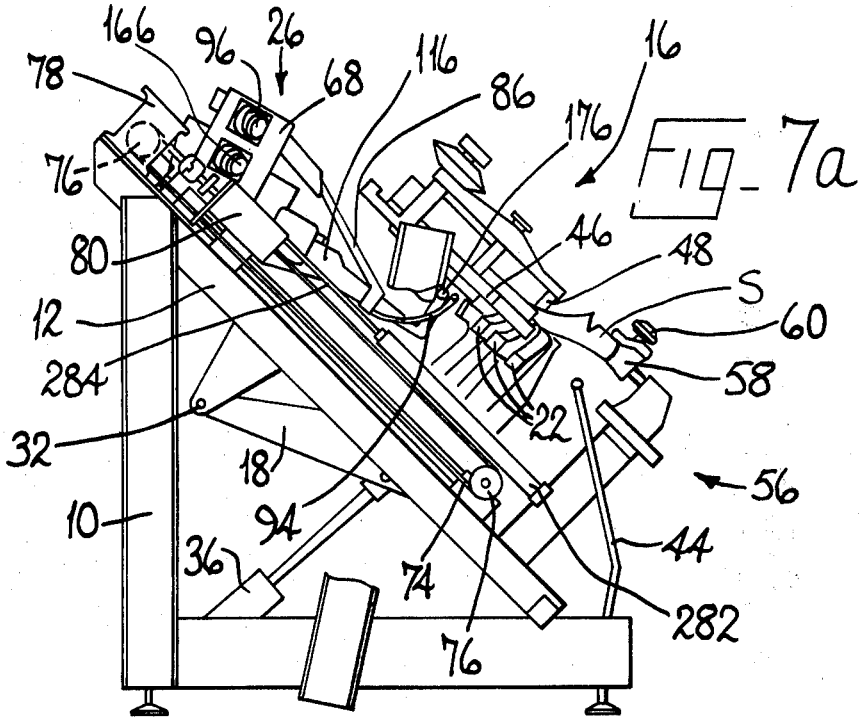
FIGS. 7*a* and 7*b* are diagrammatic representations of two stages in a cycle of operation of the machine.
Figure 7B:
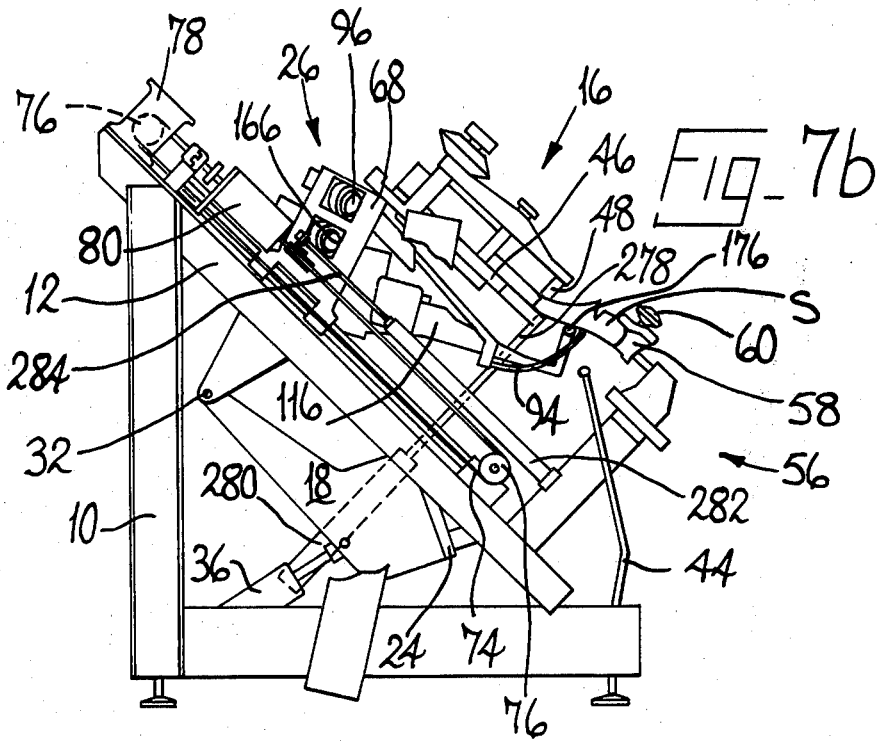

FIG. 7 also shows details of the heel support arrangement 56. Thus, it will be seen that the V-shaped block 58 has an arcuate rearward surface 294, and the block is mounted for free movement, within the constraints of spigots 296 secured thereto accommodated in slots 298 of a mounting 300 for the block 58, thus to accommodate the block to the shoe being operated upon. The thickness of the block 294 thereof engages with a surface 302 of the mounting 300, when pressed thereagainst by engagement of the block 58 with a shoe. Thus, the surface 302 provides a datum for the shoe length sensing means constituted by the linear potentiometer 66.

As already mentioned, the heel support arrangement 56 is adjustable heightwise, and to this end the mounting 300 is slidable in a guide-way provided at an upper end of the support arm 288. Furthermore, the surface 302 of the mounting 300 is formed parallel with the guide-way, so that adjusting the heightwise position of the block 58 does not affect the operation of the shoe length sensing means.

In the operation of the machine in accordance with the invention the operator loads a shoe S to be operated upon in a manner generally similar to that used with a conventional pulling over and toe lasting machine. Thus, the shoe is placed with the toe portion thereof on the insole plate 24, and the upper is fed into the various grippers 22, which are than operated to grip and tension the upper about its last. At the same time, at this stage the heel support block 58 and the auxiliary clamp members 62 are brought into engagement with the heel end of the shoe. Furthermore, for tensioning the upper as aforesaid, the insole plate 24 is moved heightwise, relative to the grippers, to a first operative position. With the upper thus tensioned, the operator can now, using the levers 44, adjust the position of the upper on its last, if he so desires.

When the operator is satisfied with the position of the upper, the next stage in the machine cycle is initiated, whereupon the toe pad 48 is brought into engagement with the toe end of the shoe, under light pressure, and also the toe band 50 applies clamping pressure to the upper. At the same time, the insole plate 24 is raised further to a second operative position to bring the shoe bottom into the "wiping plane", the grippers 22 being caused to apply a slipping grip during such upward movement. The heel support block 58 and clamp members 62 also moves upwardly with the shoe.

The shoe is now clamped by the toe band 50 and the heel support block 58 and its associated clamp members 62.

In the machine in accordance with the invention, the movement of the heel support arrangement 56 is monitored by the linear potentiometer 66, which thus supplies a reference signal to the control circuits of the machine as already mentioned.

With the upper thus tensioned and the shoe held in position, operation of the wiper head 16 is initiated, whereupon the toe wiper plates 38 are caused to advance to an "interrupt" position in which leading marginal portions of the wiper plates engage and clamp marginal portions of the upper against corresponding marginal portions of the insole, in the region of the periphery of the insole only. For thus moving the wiper plates, fluid pressure operated means in a form of a piston-and-cylinder arrangement 232 is provided, bolted to a cross-member 234 which is supported on the support members 12 of the main frame of the machine. The arrangement 232 has a forwardly projecting piston rod (not shown) which is connected, by a linkage arrangement (not shown), to the wiper plates, and also has a rearwardly projecting piston rod 236, which carries a wedge-shaped member 238, which is thus movable with the wiper plates. For arresting the movement of the wiper plates in the "interrupt" position, a stop member 240, having an inclined surface which is arranged to co-operate with an inclined surface of the member 236 (which thus constitutes an abutment), is provided, said stop member 240 being movable transversely of the path of movement of the abutment 236 by means of a piston-and-cylinder arrangement 242 bolted to the cross-member 234. The stop member 240 is thus capable of being moved into the path of movement of the abutment 238, thus to arrest the movement of the abutment, and thus of the wiper plates 38, and can be retracted to an out-of-the-way position thus to allow continued movement of the abutment 238, and thus of the wiper plates 38. The "interrupt" position of the wiper plates can be varied according to the size of shoe being operated upon; usually, where a significant difference in the length of shoe to be operated upon arises, it will also be necessary to provide appropriately sized wiper plates also. For accommodating the various "interrupt" positions, the machine comprises a further stop member 244 arranged at the opposite side of the path of movement of the abutment 238 from the stop member 240 and having a first, advanced, position in which it limits the movement of the stop member 240 into the path of movement of the abutment 238, and a retracted position, in which the stop member 240 can execute a full stroke. For moving the further stop member 244 between its two positions, a piston-and-cylinder arrangement 246 is provided, bolted on the cross-member 234.

The linear potentiometer 66, which constitutes shoe length sensing means, supplies a reference signal, as hereinbefore stated, according to the shoe size sense and, in response to such reference signal, the position of the further stop member 244 is determined. In this manner, the "interrupt" position of the wiper plates 38 can be automatically set according to the length of shoe being operated upon. Furthermore, in order to prevent possible damage to the shoe being operated upon, or indeed to the machine, a sensor arrangement generally designated 248 is provided for sensing the amount of movement of the stop member 240, and thus to ensure that the correct signal has been supplied to the piston-and-cylinder arrangement 246. The sensor arrangement 248 comprises an inductance switch 250 carried on a bar 252 secured to the piston-and-cylinder arrangement 246, and also an apertured plate 254 secured to the stop member 240, the aperatures 256 in the plate being arranged to move past the inductance switch 250 as the stop member is moved into an operative position, the arrangement being such that the distance through which the stop member 240 moves, as determined by the position of the further stop member 244, will be sensed by the number of apertures "counted". In the event that the number of "counted" apertures 256 does not correspond with the position to which the further stop member 244 should have been moved, the continued operation of the machine is prevented.

As the wipers 38 effect an inwiping movement to the "interrupt" position, the grippers 22 release their grip on the upper in timed relation with such movement, the sequence of such release being variable according to the style of shoe. To this end, signalling means is provided including a plurality of reference potentiometers (not shown), one associated with each gripper 22, by which potentiometers a reference signal can be supplied to the control circuit of the machine, such signal being pre-set. In addition, the signalling means includes a linear potentiometer 258 operatively connected to the toe wiper plates 38, said potentiometer emitting a control signal having a value which varies proportionately with the distance through which the wiper plates are moved. In the operation of the machine, the output signal of each reference potentiometer is compared with the output signal of the linear potentiometer and, when the latter signal matches a signal from a reference potentiometer is caused to release the upper marginal portion gripped thereby. In addition, the output signal of the linear potentiometer 258 is "read" at frequent intervals by the control circuits of the machine and, when the value of the signal has been found to be unchanged over a succession of such "readings", which occurs when the wiper plates have reached the "interrupt" position, a control signal is supplied which is effective to cause the operation of the machine to be continued. More specifically, the last-mentioned signal is effective to cause a fluid pressure operated piston-and-cylinder arrangement 260, which is mounted on one of the support members 12, to operated whereby to cause an actuator block 262 mounted on the piston rod 264 thereof to actuate a switch 266, whereby the first support arrangement 18 is caused to move out of its operative position to its inoperative position. When such movement has been initiated, a proximity switch (not shown) is actuated which serves to initiate advancing movement of the second support arrangement 26 along the slide rods 14. In order to ensure that the second support arrangement 26 does not collide with the first support arrangement 18, an abutment member (not shown) is mounted towards the rear of the support arrangement 18 and projects into the path of the second support arrangement 26, until such time as the first support arrangement 18 has moved wholly out of the path of movement of the second support arrangement.

The control circuits of the machine in accordance with the invention include a microprocessor (not shown) to which, inter alia, the output signals of the linear potentiometers 66, 258 and the reference potentiometers are supplied, and which causes control signals to be supplied in response to the input from said potentiometers. In addition, the stepping motors 80, 96, 166 are supplied with a sequence of control signals by the microprocessor in accordance with a programmed instruction selected according to the style of shoe being operated upon. The programmed instruction comprises digitized information relating to a shoe bottom to be operated upon, for which purpose a model size is selected for digitizing, the control circuits of the machine also including a grading program by which the digitized information can be modified according to the length, as sensed by the linear potentiometer 66, of the particular shoe being operated upon. Thus, the path of movement of the nozzles 28 and that of the rollers 176 in relation to the shoe bottom are controlled by the microprocessor in accordance with the programmed instruction, modified as aforesaid. Furthermore, in digitizing the model size, the angular relationship of the lasting rollers 176 to the shoe bottom, in planes extending both transversely of the shoe bottom and lengthwise thereof, as controlled by the piston-and-cylinder arrangements 126, 180 respectively, can be set, such settings also being modified, in the operation of the machine, in accordance with the shoe length, as sensed by the linear potentiometer 66.

As the support arrangement 26 is moved from its out-of-the-way position, beneath the wiper head 16, forwardly as aforesaid, firstly the nozzles 28 are brought into engagement with the shoe bottom, at the toe end thereof, by operation of piston-and-cylinder arrangements 90, and thereafter, after they have passed the joint region of the shoe bottom, but while the carriers 174 are still positioned beneath the wiper plates 38, the arms 116 are moved upwardly, under the action of piston-and-cylinders 146, whereupon firstly the wiping fingers 222, held in operative condition by the piston-and-cylinder arrangements 230, are brought into engagement with the under-side of the heelward end of the wiper plates 38 and are cammed thereby downwardly, and thereafter, as the wiping fingers 222 slide off the wiper plates 38, the rollers 176 engage the shoe between their associated wiping fingers, and the side lasting operation is thus initiated. When the lasting rollers 176 have thus been brought into engagement with the shoe bottom, the wiping fingers 222 are returned by the arrangements 230 to their out-of-the-way condition.

After the lasting rollers 176, in engagement with the shoe bottom, have moved a predetermined distance, the toe wiper plates 38 are then caused to continue their inwiping movement, whereby the toe lasting operation is also completed. When the toe wiper plates 38 have completed their inwiping movement, bedding pressure is applied to the lasting marginal portions of the upper and corresponding marginal portions of the insole by the toe pad 48, now applying a heavy pressure, and at the same time the diaphragm piston 60 is operated to move the heel end of the shoe downwardly also.

After the nozzles 28 completed their adhesive applying operation, they are retracted from engagement with the shoe bottom; similarly, after the lasting rollers 176 have competed the side lasting operation, they too are retracted out of engagement with the shoe bottom, and at the same time the second support arrangement 26 is caused to return to its initial position beneath the wiper head 16. When this position is reached, furthermore, the first support arrangement 18 is caused to pivot back to its initial condition, such movements taking place while the bedding pressure is maintained at the toe end of the shoe as aforesaid.

At the end of the bedding pressure dwell, the toe pad 48 and toe band 50 are retracted to their initial conditions, thereby relieving the binding forces on the bearing surfaces of the support arm 288 and shaft 290; thereafter the heel support arrangement 56 can be retracted. The arrangement 56 is thus retracted through a predetermined distance only (e.g. 5 cm), for which purpose a signal from the linear potentiometer 66 is utilized to control the operation of the piston-and-cylinder arrangement 292. Furthermore, over part at least of the retracting movement of the heel support arrangement 56, the clamp members 62 maintain their clamping engagement with the cone of the last, thereby tending to pull the shoe towards the operator, a suitable receptacle (not shown) being arranged beneath the heel support arrangement 56, into which receptacle the shoe can fall when the clamp members 62 are caused to release their grip. A flap member 268 is provided on the last support 20 for guiding the shoe, as it falls, into the receptacle.

The machine, in accordance with the invention, also comprises a digital display unit 270 and a keyboard 272. The unit 270 is arranged to display information concerning the program selected, and also is used in the event of a break-down or fault in any electrical component of the machine, to indicate which component is broken down or at fault. The display unit may also be used for instructions to the operator.

The machine, in accordance with the invention, may be set up to operate on left and right shoes alternately, or alternatively may be arranged to operate on one or other hand of shoe, as selected by the operator. Whichever mode of operation is selected, the control circuits of the machine include a left/right program, by means of which the digitised information derived from the model shoe can be used whether the shoe to be operated upon is a left or a right.

We claim:

1. A machine for performing a combined toe and side lasting operation on shoe uppers, comprising a last support, for supporting, bottom facing down, a last on which a shoe upper and insole are assembled, a plurality of grippers arranged about last support for gripping material portions of an upper and tensioning it about its last, and toe end lasting means, comprising wiper plates by which lasting marginal portions of the toe region of the upper can be wiped over and pressed against corresponding marginal portions of the insole, wherein the last support and grippers are mounted on a support arrangement which is bodily movable between an operative position, in which a last, with an upper tensioned thereon as aforesaid, is supported with the shoe bottom in a wiping plane (as determined by the wiper plates), and an out-of-the-way position, and further wherein, with the support arrangement in its operative position, the toe end lasting means is caused to operate to move the wiper plates to an "interrupt" position in which leading marginal portions thereof engage and clamp marginal portions of the upper against corresponding marginal portions of the insole in the region of the periphery of the insole only, the grippers being caused to release the upper as it is so clamped, and the machine also comprising two side lasting assemblies by which lasting marginal portions of the opposite side regions of the upper can be wiped over and pressed against corresponding marginal portions of the insole, and adhesive applying means, comprising two nozzles, movable relative to the shoe bottom whereby to cause adhesive to be applied progressively between the lasting marginal portions of the upper and corresponding marginal portions of the insole, in which machine the nozzles are mounted on a further support arrangement which is movable, beneath the level of the toe end lasting means, along a rectilinear path to cause the nozzles supported thereby to apply adhesive progressively along toe and side portions of the shoe bottom, after the inwiping movement of the wiper plates has been interrupted, and prior to such movement being continued, and also prior to operation of the side lasting assemblies, the support arrangement for the last support and grippers being mounted for movement heightwise of the machine between its operative and out-of-the-way positions, and said further support arrangement for the nozzles being movable as aforesaid when the first-mentioned support arrangement has been moved to its out-of-the-way position.

2. A machine according to claim 1 wherein each nozzle is mounted on said further support arrangement for movement heightwise of the machine, independently of the other, under the control of fluid pressure operated means, thus to bring each nozzle into and maintain it in engagement with the shoe bottom.

3. A machine according to claim 2 wherein the nozzles are mounted on said further support arrangement each for movement independently of the other widthwise of the shoe bottom.

4. A machine according to claim 3 wherein the movement of said further support arrangement along its rectilinear path is under the control of a numerically controlled motor and also a numerically controlled motor is associated with each nozzle for effecting widthwise movement thereof, said motors operating in response to a sequence of control signals supplied in accordance with a programmed instruction according to the style and size of shoe being operated upon.

5. A machine according to claim 4 wherein the further support arrangement also supports the side lasting assemblies, each assembly comprising a lasting roller rotatable about an axis extending widthwise of the shoe bottom and being provided with a wiping element disposed helically about the circumference thereof, and wherein, as said further support arrangement is caused to move along its rectilinear path as aforesaid, the lasting rollers are brought into engagement with and caused to operate along opposite side portions of the shoe bottom.

6. A machine according to claim 5 wherein each lasting roller is supported by an arm which is mounted on said further support arrangement for movement about axes extending heightwise, widthwise and lengthwise of the rectilinear path of said arrangement.

7. A machine according to claim 6 wherein fluid pressure operated means is provided for effecting movement of each arm about an axis extending widthwise of the path of said further support arrangement.

8. A machine according to claim 7 wherein said fluid pressure operated means for moving each arm about an axis extending lengthwise of the path of said further support arrangement operates in response to control signals supplies thereto in accordance with a programmed instruction according to the style and size of shoe being operated upon.

9. A machine according to claim 8 wherein each arm carries a roller support which is mounted for movement about an axis extending heightwise of said arm and passes through a portion of the operating surface of the roller, which portion engages the shoe.

10. A machine according to claim 9 wherein fluid pressure operated means is provided for effecting movement of each roller support about an axis extending heightwise of the arm.

11. A machine according to claim 10 wherein said fluid pressure operated means for moving each roller support about an axis extending heightwise of the arm operates in response to control signals supplied thereto in accordance with a programmed instruction according to the style and size of shoe being operated upon.

12. A machine according to claim 11 wherein each arm is moved about an axis extending heightwise of the path of said further support arrangement under the control of a numerically controlled motor, said motors also operating in response to a sequence of control signals supplied in accordance with a programmed instruction according to the style and size of the shoe being operated upon.

13. A machine according to claim 11 wherein a wiping finger arrangement is also carried on each roller support, means being provided for moving each arrangement on the support between an operative condition, in which it projects beyond the roller, in a direction towards the shoe bottom to be operated upon, and an out-of-the-way condition, and the arrangement being such that each arrangement is moved to its operative condition to engage the lasting marginal portion of the upper in advance of its associated roller.

14. A machine for performing a combined toe and side lasting operation on shoe uppers, comprising:

a last support, for supporting, bottom facing down, a last on which a shoe upper and insole are assembled, a plurality of grippers arranged about the last support for gripping marginal portions of an upper and tensioning it about its last, and toe lasting means, comprising wiper plates by which lasting marginal portions of the toe region of the upper can be wiped over and pressed against corresponding marginal portions of the insole, wherein the last support and grippers are mounted on a support arrangement which is bodily movable between an operative position, in which a last, with an upper tensioned thereon as aforesaid, is supported with the shoe bottom in a wiping plane (as determined by the wiper plates), and an out-of-the-way position, and further wherein, with the support arrangement in its operative position, the toe end lasting means is caused to operate to move the wiper plates to an "interrupt" position, in which leading marginal portions thereof engage and clamp marginal portions of the upper against corresponding marginal portions of the insole, in the region of the periphery of the insole only, the grippers being caused to release the upper as it is so clamped, and the machine also comprising two side lasting assemblies, each comprising a lasting roller rotatable about an axis extending widthwise of the shoe bottom and being provided with a wiping element disposed helically about the circumference thereof, the assemblies being mounted on a further support arrangement which is movable, beneath the toe end lasting means, after the inwiping movement of the wiper plates has been interrupted, and prior to such movement being continued, along a rectilinear path whereby the lasting marginal portions of the opposite side portions of the upper can be engaged and by progressively wiped over and pressed against corresponding marginal portions of the insole, and further wherein each lasting roller is mounted on a support on which also is carried a wiping finger arrangement, means being provided for moving each arrangement on the support between an operative condition, in which it projects beyond the roller, in a direction towards the shoe bottom to be operated upon, and an out-of-the-way condition, and the arrangement being such that each arrangement is moved to its operative condition to engage the lasting marginal portion of the upper in advance of its associated roller.

15. A machine according to claim 14 wherein each wiping finger arrangement comprises two fingers arranged closely adjacent and one at each side of the roller associated therewith.

16. A machine according to claim 12 wherein shoe length sensing means is provided, the arrangement being such that, when the machine is in use, the programmed instruction is selected according to the style of shoe to be operated upon and the shoe length sensing means is effective, through a grading program, to cause the path of the instrumentalities supported by the further support arrangement to be modified according to the size of such shoe.

17. A machine for performing a combined toe and side lasting operation on shoe uppers, comprising:

a last support, for supporting, bottom facing down a last on which a shoe upper and insole are assembled a plurality of grippers arranged about the last support for gripping marginal portions of an upper and tensioning it about its last, and toe end lasting means, comprising wiper plates by which lasting marginal portions of the toe region of the upper can be wiped over and pressed against corresponding marginal portions of the insole, wherein the last support and grippers are mounted on a support arrangement which is bodily movable between an operative position, in which a last, with an upper tensioned thereon as aforesaid, is supported with the shoe bottom in a wiping plane (as determined by the wiper plates), and an out-of-the-way position, and further wherein, with the support arrangement in its operative position, the toe end lasting means is caused to operate to move the wiper plates to an "interrupt" position, in which leading marginal portions thereof engage and clamp marginal portions of the upper against corresponding marginal portions of the insole, in the region of the periphery of the insole only, the grippers being caused to release the upper as it is so clamped, and the machine also comprising:

two side lasting assemblies by which lasting marginal portions of the opposite side regions of the upper can be wiped over and pressed against corresponding marginal portions of the insole, adhesive applying means, comprising two nozzles, movable relative to the shoe bottom whereby to cause adhesive to be applied progressively between the lasting marginal portions of the upper and corresponding marginal portions of the insole, in which machine the nozzles are mounted on a further support arrangement which is movable, beneath the level of the toe end lasting means, along a rectilinear path to cause the nozzles supported thereby to apply adhesive progressively along toe and side portions of the shoe bottom, after the inwiping movement of the wiper plates has been interrupted, and prior to such movement being continued, and also prior to operation of the side lasting assemblies, the support arrangement for the last support and grippers being mounted for movement heightwise of the machine between its operative and out-of-the-way position, and said further support arrangement for the nozzles being movable as aforesaid when the first-mentioned support arrangement has been moved to its out-of-the-way position, and shoe length sensing means is associated with a heel support which is movable into engagement with a heel end of a shoe to be operated upon after the upper has been gripped as aforesaid, such movement of the heel support being effective to operate said shoe length sensing means.

18. A machine according to claim 17 wherein the shoe length sensing means comprises a signalling device which is associated with the heel support and which supplies a reference signal having a value which varies proportionately with the movement of the heel support.

19. A machine for performing a toe (or a combined toe and side) lasting operation on shoe uppers comprising:

a last support, for supporting, bottom facing down, a last on which a shoe upper and insole are assembled, a plurality of grippers arranged about the last support for gripping marginal portions of an upper and tensioning it about its last, and toe end lasting means, comprising wiper plates by which lasting marginal portions of the toe region of the upper can be wiped over and pressed against corresponding marginal portions of the insole, a heel support which is movable into engagement with a heel end of a shoe to be operated upon after the upper has been gripped as aforesaid, and shoe length sensing means associated with the heel support and being effective to sensing the length of a shoe when the heel support is moved as aforesaid, wherein the shoe length sensing means comprises a signalling device which is associated with the heel support and which supplies a reference signal having a value which varies proportionately with the movement of the heel support.

20. A machine according to claim 19 wherein the signalling device is constituted by a linear potentiometer connected to the heel support.

21. A machine according to claim 20 wherein means is provided whereby the inwiping movement of the wiper plates of the toe end lasting means is interrupted, said interrupting means comprising a stop engageable by an abutment movable with the wiper plates, and wherein, for varying the "interrupt" position of the wiper plates, the stop is movable along a path, into a position determined according to the length of the shoe to be oerated upon as sensed by the shoe length sensing means, thus to vary the amount of movement of the abutment in engaging said stop, and further wherein a sensing device is provided aforesaid, means being provided for comparing the outputs of the sensing device and of the shoe length sensing means for preventing the continued operation of the machine in the event of said outputs being incompatible.

22. A machine for performing a toe (or a combined toe and side) lasting operation comprising:

a last support, for supporting, bottom facing down, a last on which a shoe upper and insole are assembled, a plurality of grippers arranged about the last support for gripping marginal portions of an upper tensioning it about its last, and toe end lasting means, comprising wiper plates by which lasting marginal portions of the toe region of the upper can be wiped over and pressed against corresponding marginal portions of the insole, wherein the toe end lasting means is caused to operate to move the wiper plates to an "interrupt" position, in which leading marginal portions thereof engage and clamp marginal portions of the upper against corresponding marginal portions of the insole, in the region of the periphery of the insole only, the grippers being caused to release the upper as it is so clamped, and means whereby the inwiping movement of the wiper plates of the toe end lasting means is interrupted, said interrupting means comprising a stop engageable by an abutment movable with the wiper plates, wherein, for varying the "interrupt" position of the wiper plates, the stop is movable along a path, into a position determined according to the length of the shoe to be operated upon as sensed by the shoe length sensing means, thus to vary the amount of movement of the abutment in engaging said stop, and further wherein a sensing device is provided aforesaid, means being provided for comparing the outputs of the sensing device and of the shoe length sensing means for preventing the continued operation of the machine in the even of said outputs being incompatible.

23. A machine according to claim 22 wherein the sensing device comprises an inductance switch between which and a member having a plurality of apertures relative movement takes place when the stop is moved along its path as aforesaid, the arrangement being such that the switch "counts" apertures, the number "counted" carrying according to the distance moved by the stop along said path.

24. A machine according to claim 18 wherein the heel support comprises a support arm carried on a rectangular shaft for sliding movement therealong, the arrangement being such that pressing the heel support against a shoe causes the support arm to bind on the shaft, thus to lock the heel support in position.

25. A machine for performing a toe (or a combined toe and side) lasting operation on shoe uppers comprising:

a last support, for supporting, bottom facing down, a last on which a shoe upper and insole are assembled, a plurality of grippers arranged about the 1st support for gripping marginal portions of an upper and tensioning it about its last, toe end lasting means, comprising wiper plates by which lasting marginal portions of the toe region of the upper can be wiped over and pressed against corresponding marginal portions of the insole, and a heel support which is movable into engagement with a heel end of a shoe to be operated upon, after the upper has been gripped as aforesaid, the heel support comprising a support arm carried on a rectangular shaft for sliding movement therealong, the arrangement being such that pressing the heel support against a shoe, causes the support arm to bind on the shaft, thus to lock the heel support in position.

26. A machine according to claim 24 wherein, at the end of a cycle of operation, the toe end portion of the shoe is released prior to the heel support being retracted from pressing engagement with the shoe.

27. A machine for performing a toe (or a combined toe and side) lasting operation on shoe uppers comprising:

a last support, for supporting, bottom facing down, a last on which a shoe upper and insole are assembled, a plurality of grippers arranged about the last support for gripping marginal portions of an upper and tensioning it about its lasts, toe end lasting means, comprising wiper plates by which lasting marginal portions of the toe region of the upper can be wiped over and pressed against corresponding marginal portions of the insole, and a heel support which is movable into engagement with a heel end of a shoe to be operated upon, after the upper has been gripped as aforesaid, said heel support comprising auxiliary clamp means which are arranged to engage with opposite sides of the last after the upper has been gripped and tensioned as aforesaid, the arrangement being such that, when, at the end of a machine cycle, the heel support is retracted to release the shoe, the auxiliary clamp means remains in clamping engagement with the shoe over at least part of the retracting movement of the heel support.

28. A machine according to wherein, at the end of a cycle of operation, the heel support is retracted through a predetermined distance out of pressing engagement with the shoe.

29. A machine according to claim 27 wherein there is associated with the toe end lasting means a signalling device which supplies a signal having a value which varies proportionately with the movement of the wiper plates, the arrangement being such that, as the toe end lasting means is caused to operate, the signal is "read" at frequent intervals and, upon the value of the signal being "read" as unchanged over a succession of readings, thereby indicating that the movement of the wiper plates has been interrupted, said support arrangement for the last support and grippers is caused to move to its out-of-the-way position.

* * * * *

UNITED STATES PATENT OFFICE

CERTIFICATE OF CORRECTION

Patent No. 4,407,033 Dated October 4, 1983

Inventor(s) D. H. Garner, F. C. Price, P. Reader, D. Whittingham, A. White, J. Shutt, N. Campling It is certified that error appears in the above-identified patent and that said Letters Patent are hereby corrected as shown below:

Claim 1 - Line 27 - delete [material] insert - marginal -

Claim 14 - Line 58 - delete [by] insert - be -

Signed and Sealed this

Twenty-third Day of October 1984

[SEAL]

Attest:

GERALD J. MOSSINGHOFF

Attesting Officer

Commissioner of Patents and Trademarks